US006348290B1

(12) United States Patent
Yokota

(10) Patent No.: US 6,348,290 B1
(45) Date of Patent: Feb. 19, 2002

(54) MULTILAYER ORGANIC PHOTOCONDUCTOR INCLUDING ELECTRICALLY CONDUCTIVE SUPPORT HAVING SPECIFIC INDEX OF SURFACE AREA

(75) Inventor: Saburo Yokota, Saitama (JP)

(73) Assignee: Nippon Ink and Chemicals, Inc., Tokyo (JP)

( * ) Notice: Subject to any disclaimer, the term of this patent is extended or adjusted under 35 U.S.C. 154(b) by 787 days.

(21) Appl. No.: 08/610,069

(22) Filed: Feb. 29, 1996

(30) Foreign Application Priority Data

Aug. 3, 1995 (JP) ..... 7-198468

(51) Int. Cl.[7] ..... G03G 5/047
(52) U.S. Cl. ..... 430/57.3; 430/57.2; 430/69
(58) Field of Search ..... 430/69, 58, 57.2, 430/59.3, 59.1, 59.4, 59.5, 57.3

(56) References Cited

U.S. PATENT DOCUMENTS 4,735,883 A * 4/1988 Honda et al. ..... 430/69

FOREIGN PATENT DOCUMENTS

JP 3-37657 * 2/1991
JP 3-37658 * 2/1991
JP 7-160010 * 6/1995

* cited by examiner

*Primary Examiner*—Christopher Rodee
(74) *Attorney, Agent, or Firm*—Armstrong, Westerman, Hattori, McLeland & Naughton, LLP

(57) ABSTRACT

An organic photoconductor is disclosed, which comprises a cylindrical electrically conductive support and, formed thereon in this order, a charge-generating layer and a charge-transporting layer, the external surface of the cylindrical electrically conductive support having an index of surface area as defined by the following equation (I) of from 0.01 to 0.10, and the charge-generating layer having a multilayer structure comprising a charge-generating layer having n-type semiconductor characteristics and a charge-generating layer having p-type semiconductor characteristics:

$$(S_a/S_m)-1 \quad \text{(I)}$$

wherein $S_a$ is the actual surface area of the external surface of the cylindrical electrically conductive support and $S_m$ is the theoretical surface area thereof calculated on the assumption that the support is an ideal cylinder. The organic photoconductor of the present invention employs an inexpensive cylindrical electrically conductive support and is excellent in electrical properties and image quality despite the use of the inexpensive support.

19 Claims, 1 Drawing Sheet

MULTILAYER ORGANIC PHOTOCONDUCTOR INCLUDING ELECTRICALLY CONDUCTIVE SUPPORT HAVING SPECIFIC INDEX OF SURFACE AREA

FIELD OF THE INVENTION

The present invention relates to an organic photoconductor. More particularly, this invention relates to an organic photoconductor which employs an inexpensive cylindrical electrically conductive support and is excellent in electrical properties and image quality despite the use of the inexpensive support.

BACKGROUND OF THE INVENTION

In general, an organic photoconductor is composed of an electrically conductive support and formed thereon a photosensitive layer comprising a photoconductive material. Generally employed as this electrically conductive support is a cylindrical electrically conductive support made of a metal, e.g., aluminum. Organic photoconductors in frequent use have a function allocation type multilayered photosensitive layer comprising a charge-generating layer and a charge-transporting layer.

To cope with enlargement in sensible-wavelength region or with special development techniques such as multiple exposure, organic photoconductors having a multilayered charge-generating layer consisting of two or more layers have been proposed in, e.g., JP-A-50-75042 (U.S. Pat. No. 3,992,205), JP-A-63-38942, JP-A-63-142356, JP-A-63-292136, JP-A-1-185635, and JP-A-6-27689. (The term "JP-A" as used herein means an "unexamined published Japanese patent application.")

In most of such organic photoconductors, the external surface of the cylindrical electrically conductive support has conventionally been finished by turning by means of a precision lathe or the like. It is usually necessary that the external surface of such cylindrical electrically conductive supports be regulated so as to have a surface roughness not higher than a specific value in order to avoid image defects. It should be noted in this connection that suitability of a cylindrical electrically conductive support for use in an organic photoconductor can be more infallibly judged by use of the index of surface area as defined by the following equation (I) as an index to surface roughness than by the center-line average roughness $R_a$ or the maximum surface roughness $R_{max}$ which are both frequently used as an ordinary index to surface roughness.

$$(S_a/S_m)-1 \quad \text{(I)}$$

(In equation (I), $S_a$ is the actual surface area of the external surface of the cylindrical electrically conductive support and $S_m$ is the theoretical surface area thereof calculated on the assumption that the support is an ideal cylinder.)

This index of surface area can be easily measured, for example, with an apparatus such as scanning electron stereomicroscope ERA-8000, sold by ELIONIX K.K.

The commonly used cylindrical electrically conductive supports which have undergone surface finishing by means of turning have a value of the index of surface area smaller than 0.01, in most cases 0.005 or smaller. It has been found that in an organic photoconductor comprising a cylindrical electrically conductive support having a roughly finished surface with a value of the index of surface area of 0.01 or smaller and formed thereon a conventional photosensitive layer consisting of a charge-generating layer and a charge-transporting layer, the possibility of print defects appearing on images is fairly high.

In recent years, cylindrical electrically conductive supports which have undergone surface finishing by means of not turning but precision drawing, ironing, impacting, or the like for the purpose of production-cost reduction have also become available. However, such supports have surface properties utterly different from those of conventional supports; specifically, they inevitably have both groove defects in the form of streaks parallel to the cylinder axis and depression defects in the form of holes. Because of such surface properties, the cylindrical electrically conductive supports produced through any of the non-turning surface-finishing techniques have a value of the index of surface area of 0.01 or larger, in most cases 0.02 or larger. Organic photoconductors comprising such a cylindrical electrically conductive support and formed thereon a conventional photosensitive layer consisting of a charge-generating layer and a charge-transporting layer are apt to cause image defects as different from the organic photoconductors employing a cylindrical electrically conductive support finished by turning, which tend less to cause such defects. This drawback has been an obstacle to the spread of the cylindrical electrically conductive supports finished by non-turning processing.

On the other hand, it is known that in function allocation type multilayered organic photoconductors, the properties thereof vary considerably depending on electrical junction between the cylindrical electrically conductive support and the charge-generating layer. For example, in an ordinary non-rectifying (so-called ohmic type) junction, in which electric current is proportional to electric field, charges are always injected from the cylindrical electrically conductive support during electrification, resulting in a diminished surface potential to significantly reduce the organic-photoconductor's ability to be charged. In this case, the ability to be charged can be enhanced by forming an electrical barrier layer between the photosensitive layer and the cylindrical electrically conductive support to inhibit the injection of charges from the cylindrical electrically conductive support. In contrast, organic photoconductors having a junction of the so-called Schottky type, for example, organic photoconductors employing a combination of a cylindrical electrically conductive support made of a metal having a small work function, such as aluminum, and a phthalocyanine compound as a charge-generating material, are known to be inhibited from undergoing charge injection from the support due to the rectifying function of the junction and to show relatively high ability to be charged even without a barrier layer.

However, in this case also, local drops in potential occur due to the defects and crystallized impurities scatteringly present on the surface of the cylindrical electrically conductive support and due to impurities in the coating, etc. It is known that these local potential drops may result in print defects on images, especially in reversal development. To cope with this problem, a barrier layer is generally formed.

Prior art organic photoconductors designed to have improved functions by means of a barrier layer have the following drawbacks. For example, in the case of organic photoconductors employing a barrier layer made of an electrical insulating polymer, materials usable as the barrier layer are considerably limited, because they not only are required to have moderate barrier properties and adherence but also should satisfy requirements including freedom from dissolution during coating for forming an overlying layer.

Examples of conventionally generally used polymeric materials which satisfy such requirements include hydrophilic resins such as casein, poly(vinyl alcohol), polyamides, and poly(vinyl butyral). Such barrier layers have a problem that too small a film thickness results in insufficient barrier properties and insufficient hiding of substrate defects, while too large a film thickness undesirably results in inhibition of charge injection from the photosensitive layer to the support, leading to a decrease in sensitivity and an increase in residual potential. Another problem is that since those barrier layers are made of a highly hydrophilic material which is apt to absorb water, they upon water absorption not only undergo a decrease in barrier property to impair photoconductor properties but also frequently cause other troubles such as insufficient adhesion to the photosensitive layer.

A technique of using as a barrier layer a film of an insulating inorganic compound such as, e.g., $Al_2O_3$ or $SiO_2$ is disclosed in, e.g., JP-A-2-7070 and JP-A-3-192265. This technique however has drawbacks in that since such an insulating inorganic-compound film should be formed by a chemical treatment or a technique such as vacuum deposition or sputtering, not only much time is required for barrier layer formation but the formation of such a barrier layer results in a considerably increased production cost, etc. In addition, like barrier layers of the resinous coating type, the inorganic barrier layers have unsolved problems of decrease in sensitivity and increase in residual potential.

Furthermore, a technique of using as a barrier layer a layer comprising white inorganic particles of $TiO_2$, ZnO, or the like dispersed in a resin is disclosed in, e.g., JP-A-57-81269 and JP-A-59-139967. However, this prior art barrier layer not only has basically the same drawbacks as the resinous coating type barrier layers, but also necessitates extremely troublesome regulations concerning the purity, particle diameter, and surface state of the inorganic material, blending ratio thereof to the resin, etc. so as to obtain organic photoconductor properties suitable for practical use.

As described above, the conventionally employed general method for improving functions of multilayered organic photoconductors, in particular charge acceptance and image properties, has been used to form an independent barrier layer. However, the prior art photoconductors having a barrier layer have insufficient properties for application to cylindrical electrically conductive supports which have not undergone surface finishing by turning and have a large value of the index of surface area.

SUMMARY OF THE INVENTION

An object of the present invention is to provide an organic photoconductor which employs an inexpensively produced cylindrical electrically conductive support having a surface finished by a technique other than turning and having a value of the index of surface area of from 0.01 to 0.10 and does not necessitate a barrier layer, and which is comparable or superior in charge acceptance and image properties to organic photoconductors employing a conventional cylindrical electrically conductive support finished by turning and having a value of the index of surface area below 0.01.

As a result of investigations made by the present inventor on a large number of materials and layer constitutions in order to satisfy various properties required of an organic photoconductor, the present invention has been achieved.

To accomplish the above object, the present invention provides an organic photoconductor comprising a cylindrical electrically conductive support and, formed thereon in this order, a charge-generating layer and a charge-transporting layer, the external surface of said cylindrical electrically conductive support having an index of surface area as defined by the following equation (I) of from 0.01 to 0.10, and said charge-generating layer having a multilayer structure comprising a charge-generating layer having n-type semiconductor characteristics and a charge-generating layer having p-type semiconductor characteristics:

$$(S_a/S_m)-1 \quad \text{(I)}$$

wherein $S_a$ is the actual surface area of the external surface of said cylindrical electrically conductive support and $S_m$ is the theoretical surface area thereof calculated on the assumption that said support is an ideal cylinder.

Figure 2:
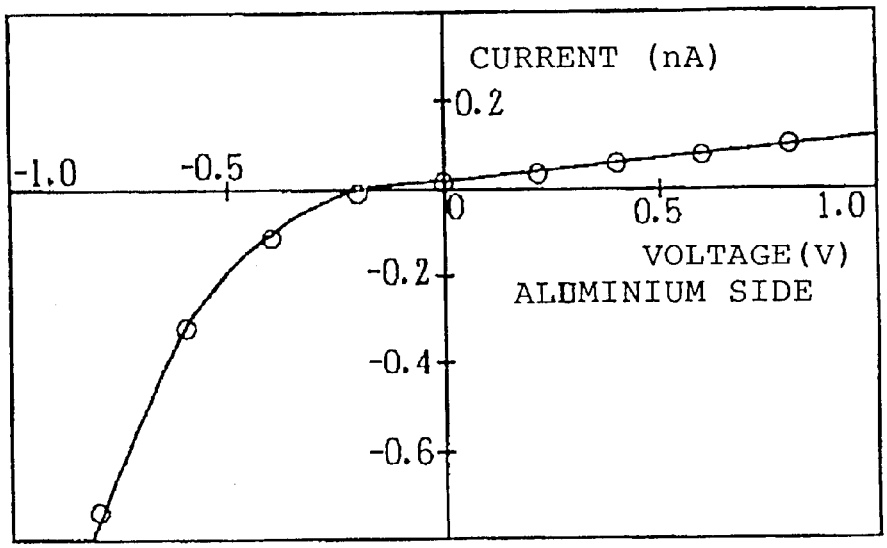

Description of the Symbols:

1 cylindrical electrically conductive support
2 photosensitive layer
3 charge-generating material
4 charge-generating material
5 binder
6 first charge-generating layer
7 second charge-generating layer
8 charge-transporting layer FIG. 2 is a graph showing the relationship between voltage and current obtained by applying a voltage to the aluminum and gold of an aluminum/first charge-generating layer/gold sandwich cell obtained by forming the same first charge-generating layer as in Example 1 on an aluminum plate and vapor-depositing a gold film thereon as an electrode.

DETAILED DESCRIPTION OF THE INVENTION

The charge-generating layer preferably has a multilayer structure comprising a first charge-generating layer in contact with the cylindrical electrically conductive support and a second charge-generating layer, with the thickness of the first charge-generating layer being in the range of from 1.0 to 10.0 $\mu$m. In this case, a charge-generating material contained in the first charge-generating layer in contact with the support is preferably in non-rectifying junction with the support. It is also preferred that the first charge-generating layer be a charge-generating layer having n-type semiconductor characteristics and the second charge-generating layer be a charge-generating layer having p-type semiconductor characteristics.

Such a constitution enables the organic photoconductor of the present invention to combine excellent electrical properties and excellent image properties and to be produced at a considerably reduced cost.

The reasons why the organic photoconductor of the present invention can exhibit excellent electrical properties and excellent image quality despite the use of a cylindrical electrically conductive support having a large value of the index of surface area may be as follows.

The surface state of a cylindrical electrically conductive support which has not undergone surface finishing by turning differs distinctly from that of the ordinarily used supports which have undergone surface finishing by turning. In particular, the former support has many surface defects such as groove defects in the form of streaks parallel to the cylinder axis and depression defects in the form of holes. As a result, the cylindrical electrically conductive support which has not undergone surface finishing by turning is characterized as having a large value of the index of surface area.

Image defects attributable to these surface defects can be avoided extremely effectively by making the charge-generating layer have a multilayer structure comprising at least a charge-generating layer having n-type semiconductor characteristics and a charge-generating layer having p-type semiconductor characteristics. This enhanced defect-hiding effect of the multilayered charge-generating layer may be attributable to a physically increased hiding effect due to the substantial increase in charge-generating layer thickness resulting from the multilayer constitution and to a change of the state of interfacial energy barrier resulting from contact between different kinds of charge-generating materials. Remarkable improvements in electrophotographic properties are attained especially when the charge-generating layer has a multilayer structure comprising, from the support side, a charge-generating layer having n-type semiconductor characteristics and a charge-generating layer having p-type semiconductor characteristics.

Unlike organic photoconductors designed to hide defects by means of a thick barrier layer, the organic photoconductor of the present invention has no barrier to charge injection from the charge-generating layer into the support and is hence free from deterioration in electrical properties, e.g., an increase in residual potential. Thus, the organic photoconductor of the present invention can also have excellent performances.

Further, since the organic photoconductor of the present invention has an excellent barrier to charge injection from the support as described above, the photoconductor has an advantage that it is more free from the generation of image defects caused by charge leakage, even when used in electrophotographic apparatuses of the contact charging type using a roller, a brush, or the like, which apparatuses have come to spread in recent years.

The reasons why the organic photoconductor has excellent electrophotographic properties can be explained as follows. The structure in which an n-type semiconductor is in contact with a p-type semiconductor shows excellent rectifying properties, as apparent from its common name of p-n junction diode. The excellent rectifying properties thereof may be attributable to the formation of an insulating layer filled with space charges, which is called a depletion layer, at the junction interface and to the depletion-layer's function to inhibit charge transfer during incorrect electrification. It is generally thought that the depletion layer has, inside the same, a local electric field having a far higher intensity than an applied external electric field. These properties are expected to produce the same effects as described above, because even a resin dispersion of a charge-generating material for use in the present invention clearly functions to rectify at the junction thereof with a specific metal, as seen in the experimental results shown in Examples given later. For example, in the case of an organic photoconductor comprising a cylindrical electrically conductive support and, formed thereon in this order, a charge-generating layer having n-type semiconductor characteristics, a charge-generating layer having p-type semiconductor characteristics, and a hole transport type charge-transporting layer, the electric field applied for charging is a reverse bias for the p-n junction since this organic photoconductor is negatively charged during use and, as a result, the depletion layer functions as an effective barrier to hole injection from the substrate, which injection leads to a decrease in the ability to be charged and to image defects. When the organic photoconductor in this state is then irradiated with light, the intense local electric field inside the depletion layer greatly contributes to the dissociation of ion pairs formed by the irradiation, whereby charges are formed extremely efficiently. Of the positive and negative charges which have been formed within the depletion layer, the electrons are easily injected into the substrate through the first charge-generating layer having n-type semiconductor characteristics, while the holes are easily transferred through the second charge-generating layer having p-type semiconductor characteristics and the charge-transporting layer to neutralize surface charges. Consequently, the organic photoconductor combines excellent defect-hiding power and satisfactory charge acceptance and sensitivity characteristics, thus realizing excellent performances.

Furthermore, in the organic photoconductor of the present invention, the preferably effective state of the junction of the cylindrical electrically conductive support and the first charge-generating layer is a non-rectifying (ohmic) junction. The reasons for this are as follows.

In conventional organic photoconductors, a slight change in the state of contact between the support and the photosensitive layer results in a considerable property change, because charge injection in those organic photoconductors is inhibited by a rectifying junction, represented by the Schottky junction, between the support and the charge-generating layer or by the electric resistance of an independent barrier layer. For example, in the case where the support surface has a fouled part or defects, formation of an effective barrier is inhibited thereby, so that the possibility of print defects appearing on images is extremely high. In contrast, the organic photoconductor having a non-rectifying junction of the support and the first charge-generating layer eliminates the necessity of delicate regulation of conditions for barrier formation, since the contact between the first charge-generating layer and the support is a non-rectifying (ohmic) junction. Moreover, in this organic photoconductor of the present invention, since charge injection is inhibited at the interface between the first and second charge-generating layers, which is apart from the support surface, the influence of the support is slight and, hence, high-quality images can be obtained even when the support used has a large value of the index of surface area.

Consequently, an independent barrier layer is basically unnecessary in the organic photoconductor of the present invention. Accordingly, even though the charge-generating layer has a two-layer structure, there is an advantage that the constituent layers each can be produced by coating in a conventional manner.

In the organic photoconductor of the present invention, two kinds of charge-generating materials contribute to sensitivity. Therefore, the effect of realizing a panchromatic organic photoconductor having an enlarged sensible-wavelength region can be expected.

Furthermore, in the organic photoconductor of the present invention, the charge-generating layer can be made to have a considerably larger thickness than the charge-generating layer in ordinary multilayered organic photoconductors. In this case, when the organic photoconductor of this invention is used in an electrophotographic apparatus in which a latent image is formed by exposure with a coherent light, as in a laser printer or the like, most of the incident light is diffused and absorbed within the charge-generating layer, thereby producing the effect of preventing the generation of interference fringes caused by interference of light reflected from the support surface with light reflected from the photosensitive-layer surface.

Figure 1:
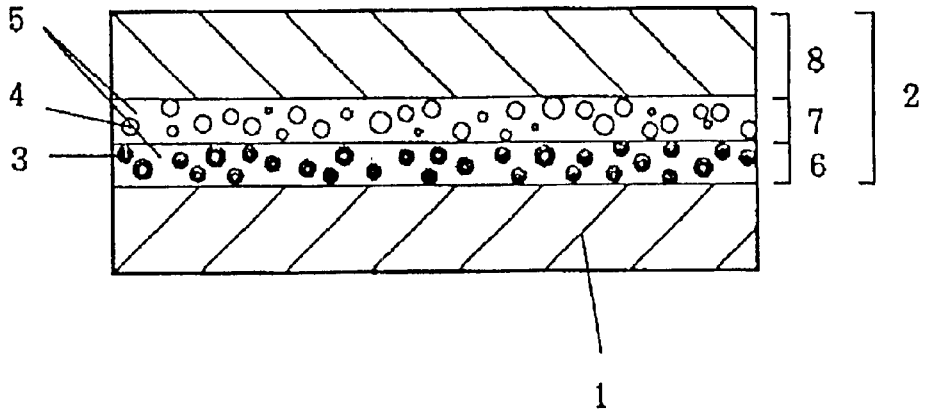
FIG. 1 is a diagrammatic sectional view showing one embodiment of the layer constitution of the organic photoconductor according to the present invention.

In FIG. 1 is shown a possible example of the photosensitive-layer structure in the organic photoconductor of the present invention. The organic photoconductor illustrated in FIG. 1 comprises a cylindrical electrically conductive support with a specific value of the index of surface area and, formed thereon in this order, a first charge-generating layer, a second charge-generating layer, and a charge-transporting layer. The thickness of the first charge-generating layer is preferably in the range of from 1 to 10 $\mu$m from the standpoint of hiding defects of the support. The thickness of the second charge-generating layer is preferably in the range of from 0.1 to 5 $\mu$m and smaller than that of the first charge-generating layer. The thickness of the charge-transporting layer is preferably in the range of from 5 to 50 $\mu$m. In the case where the charge-generating layers and the charge-transporting layer are formed by dip coating, the thickness of each layer can be easily regulated to a desired value by controlling the rate of dip coating, the viscosity of the coating composition, shearing force, or other conditions.

Examples of the material of the cylindrical electrically conductive support for use in the organic photoconductor of the present invention include metals such as aluminum, copper, zinc, stainless steel, chromium, nickel, molybdenum, vanadium, indium, gold, and platinum and alloys of these metals. An especially suitable material of the cylindrical electrically conductive support for use in the present invention is aluminum or an alloy thereof because of its superiority in processability, electrical properties, etc.

The cylindrical electrically conductive support for use in the present invention is characterized in that the surface thereof has groove defects in the form of streaks parallel to the cylinder axis and depression defects in the form of holes, and that the index of surface area as defined by equation (I) given hereinabove is in the range of from 0.01 to 0.10. Such cylindrical electrically conductive supports are produced by a non-turning technique of precision surface finishing such as, e.g., precision drawing or ironing. For determining the index of surface area, an apparatus such as, e.g., scanning electron stereomicroscope ERA-8000, sold by ELIONIX K.K., can be used.

Examples of charge-generating material that can be used in the charge-generating layer include various organic pigments such as azo pigments, quinone pigments, perylene pigments, indigo pigments, thioindigo pigments, bisbenzimidazole pigments, phthalocyanine pigments, quinacridone pigments, quinoline pigments, lake pigments, azolake pigments, anthraquinone pigments, oxazine pigments, dioxazine pigments, and triphenylmethane pigments.

Whether a charge-generating layer shows n-type semiconductor characteristics or p-type semiconductor characteristics depends on the semiconductor characteristics of the charge-generating material itself contained in the charge-generating layer, that is, depends on the greatness of the ability thereof to transport electrons or to transport holes. In determining whether a charge-generating material has n-type or p-type semiconductor characteristics, evaluation by, e.g., photoelectric-current measurement is effective. Although there are various modes of carrying out this evaluation, the technique called pulse photoelectric-current method provides a large quantity of information and is generally employed. In the case of evaluation by this method, the sample to be examined is prepared by forming on an electrode a film comprising a charge-generating material for use in a charge-generating layer and a binder, e.g., an electrically insulating resin, and further forming a transparent or translucent electrode thereon. In this measurement, the charge-generating layer is irradiated through the transparent or translucent electrode with pulse light having such a wavelength that the light is absorbable by the charge-generating material while applying a voltage to the upper and lower electrodes, and the resulting weak electric current flowing through the electrodes is observed. The semiconductor characteristics of the charge-generating material and of the charge-generating layer can be easily determined from the direction of the electric field applied to the electrodes and from the photoelectric current flowing therethrough. For example, in the case of a charge-generating layer having n-type semiconductor characteristics, a photoelectric current is observed when a negative voltage is applied to the transparent electrode, because electrons serve as charge carriers in this case. In contrast, in the case of a charge-generating layer having p-type semiconductor characteristics, a photoelectric current is observed when a positive voltage is applied, because holes serve as charge carriers in this case.

Examples of charge-generating material having n-type semiconductor characteristics include disazo pigments, perylene pigments, anthanthrone pigments, perinone pigments, and quinacridone pigments. Examples of charge-generating material having p-type semiconductor characteristics include organic pigments such as various phthalocyanine pigments and merocyanine dyes. It should however be noted that the semiconductor characteristics of a charge-generating material are not always determined by the basic framework of the substance and can change depending on the kind of substituents, crystal form, etc. It is therefore desirable to ascertain the semiconductor characteristics of charge-generating materials by the above or another method prior to practical use thereof.

Charge-generating materials that can be used in the organic photoconductor of the present invention should not be construed as being limited to the examples enumerated above. A single charge-generating material or a mixture of two or more charge-generating materials may be used in each charge-generating layer. These charge-generating materials are dispersed in a binder and applied to form films serving as the individual charge-generating layers.

In each charge-generating layer, additives such as a dispersion stabilizer and a leveling agent may be used besides a binder.

Preferred combinations of a charge-generating material having n-type semiconductor characteristics and a charge-generating material having p-type semiconductor characteristics include combinations of a disazo pigment and a phthalocyanine pigment, combinations of a perylene pigment and a phthalocyanine pigment, combinations of an anthanthrone pigment and a phthalocyanine pigment, and combinations of a perinone pigment and a phthalocyanine pigment. Especially preferred phthalocyanine pigments for use in these combinations are a titanyl phthalocyanine pigment and a metal-free phthalocyanine pigment.

Whether a cylindrical electrically conductive support and a charge-generating layer in contact therewith are in non-rectifying junction with each other or not is determined by the combination of the material of the cylindrical electrically conductive support and the charge-generating material contained in the charge-generating layer which is in contact with the support. For example, in the case of using a support made of a material having a small work function, e.g., aluminum, a non-rectifying junction can be established generally by using a charge-generating material having a small work function. Likewise, in the case of using a support made of a material having a large work function, e.g., gold or ITO, a non-rectifying junction can be established by using a charge-generating material having a large work function.

The state of rectifying junction in a sample can be easily ascertained by sandwiching the sample between different metals to fabricate a sandwich cell and examining the cell for voltage/current characteristics to examine the rectifying properties thereof, as shown in Examples given later.

Preferred binders for use in the charge-generating layers are electrical insulating polymers capable of forming a film. Examples of such polymers include polycarbonates, polyesters, methacrylic resins, acrylic resins, poly(vinyl chloride), poly(vinylidene chloride), polystyrene, poly(vinyl acetate), styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly(N-vinylcarbazole), poly(vinyl butyral), poly(vinyl formal), polysulfones, casein, gelatin, poly(vinyl alcohol), ethyl cellulose, phenolic resins, polyamides, carboxymethyl cellulose, vinylidene chloride polymer latexes, and polyurethanes. However, usable binders are not limited thereto. These binders may be used alone or as a mixture of two or more thereof.

In the case of using dip coating for forming the charge-generating layers, the coating composition for forming the first charge-generating layer preferably has a viscosity of from 10 to 100 cP (centipoises), and the coating composition for forming the second charge-generating layer or any charge-generating layer overlying the same preferably has a viscosity of from 5 to 50 cP.

Charge-transporting materials are generally classified into two groups, electron-transporting materials and hole-transporting materials. Both kinds of materials are usable in the organic photoconductor of the present invention.

Examples of electron-transporting materials include organic compounds such as chloranil, bromanil, tetracyanoethylene, tetracyanoquinodimethane, 2,4,7-trinitro-9-fluorenone, 2,4,5,7-tetranitro-9-fluorenone, 9-dicyanomethylene-2,4,7-trinitrofluorenone, 9-dicyanomethylene-2,4,5,7-tetranitrofluorenone, 2,4,5,7-tetranitroxanthone, 2,4,8-trinitrothioxanthone, tetranitrocarbazolylchloranil, 2,3-dichloro-5,6-dicyanobenzoquinone, 2,4,7-trinitro-9,10-phenanthrenequinone, tetrachlorophthalic anhydride, and diphenoquinone derivatives; and inorganic materials such as amorphous silicon, amorphous selenium, tellurium, selenium-tellurium alloys, cadmium sulfide, antimony sulfide, zinc oxide, and zinc sulfide.

Examples of low-molecular hole-transporting materials include pyrene; carbazole compounds such as N-ethylcarbazole, N-isopropylcarbazole, and N-phenylcarbazole; hydrazones such as 9-ethylcarbazole-3-carboxyaldehyde methylphenylhydrazone, 9-ethylcarbazole-3-carboxyaldehyde diphenylhydrazone, p-(N,N-dimethylamino)benzaldehyde diphenylhydrazone, p-(N,N-diethylamino)benzaldehyde diphenylhydrazone, p-(N,N-diphenylamino)benzaldehyde diphenylhydrazone, 1-[4-(N,N-diphenylamino)benzylideneimino]-2,3-dimethylindoline, N-ethylcarbazolyl-3-methylidene-N-aminoindoline, and N-ethylcarbazolyl-3-methylidene-N-aminotetrahydroquinoline; oxadiazole compounds such as 2,5-bis(p-diethylaminophenyl)-1,3,4-oxadiazole; pyrazoline compounds such as 1-phenyl-3-(p-diethylaminostyryl)-5-(p-diethylaminophenyl)pyrazoline and 1-[quinolyl-(2)]-3-(p-diethylaminophenyl)pyrazoline; arylamines such as triphenylamine, tri-p-tolylamine, N,N,N',N'-tetraphenyl-1,1'-diphenyl-4,4'-diamine, and N,N'-diphenyl-N,N'-bis(3-methylphenyl)-1,1'-biphenyl-4,4'-diamine; butadiene compounds such as 1,1-bis(p-diethylaminophenyl)-4,4-diphenyl-1,3-butadiene; and styryl compounds such as 4-(2,2-diphenylethenyl)-N,N-diphenylbenzenamine and 4-(1,2,2-triphenylethenyl)-N,N-diphenylbenzenamine.

Examples of high-molecular hole-transporting materials include poly(N-vinylcarbazole), a halogenated poly(N-vinylcarbazole), poly(vinylpyrene), poly(vinylanthracene), poly(vinylacridine), pyrene-formaldehyde resins, ethylcarbazole-formaldehyde resins, triphenylmethane polymers, and polysilanes.

These materials may be dispersed into a binder, before being applied by dip coating or another technique to form a charge-transporting layer. Usable charge-transporting materials should not be construed as being limited to the above-enumerated examples. These charge-transporting materials may be used alone or as a mixture of two or more thereof.

The binders enumerated hereinabove for use in the charge-generating layers may be used for the charge-transporting layer either alone or as a mixture of two or more thereof.

Besides these binders, additives may be used such as a plasticizer, a surface modifier, an antioxidant, and a photodegradation inhibitor.

Examples of the plasticizer include biphenyl, biphenyl chloride, terphenyl, dibutyl phthalate, diethylene glycol phthalate, dioctyl phthalate, triphenyl phosphate, methylnaphthalene, benzophenone, chlorinated paraffin, polypropylene, polystyrene, and various fluorohydrocarbons.

Examples of the surface modifier include silicone oils and fluororesins.

Examples of the antioxidant include phenolic antioxidants such as 2,6-di-t-butyl-p-cresol, butylated hydroxyanisole, 2,6-di-t-butyl-4-ethylphenol, stearyl β-(3,5-di-t-butyl-4-hydroxyphenyl)propionate, 2,2'-methylenebis(4-methyl-6-t-butylphenol), 2,2'-methylenebis(4-ethyl- 6-t-butylphenol), 4,4'-thiobis(3-methyl-6-t-butylphenol), 1,3,5-trimethyl-2,4,6-tris(3,5-di-t-butyl-4-hydroxybenzyl)benzene, butylhydroxyanisole, 2,5-di-t-octylhydroquinone, 2,6-di-n-dodecylhydroquinone, and 2-t-octyl-5-methylhydroquinone; sulfur-compound antioxidants such as dilauryl thiodipropionate, dimyristyl thiodipropionate, and distearyl thiodipropionate; phosphorus-compound antioxidants such as 10-(3,5-di-t-butyl-4-hydroxybenzyl)-9,10-dihydro-9-oxa-10-phosphaphenanthrene 10-oxide and 10-decyloxy-9,10-dihydro-9-oxa-10-phosphaphenanthrene; and amine antioxidants such as N-n-butyl-p-aminophenol, N,N'-diisopropyl-p-phenylenediamine, N,N'-bis(1,4-dimethylpentyl)-p-phenylenediamine, N,N'-diphenyl-p-phenylenediamine, and N-phenyl-α-naphthylamine.

Examples of the photodegradation inhibitor include benzotriazole compounds, benzophenone compounds, and hindered amine compounds.

In the case where a charge-generating layer or the charge-transporting layer is formed by dip coating, use is made of a coating composition prepared by mixing any of the above-enumerated charge-generating materials or charge-transporting materials with a binder and other optional ingredients and dissolving this mixture in a solvent. Although the kind of the solvent used for dissolving the binder varies depending on the kind of the binder, it is preferred to select a solvent in which the underlying layer does not dissolve. Specific examples of organic solvents include alcohols such as methanol, ethanol, and n-propanol; ketones such as acetone, methyl ethyl ketone, and cyclohexanone; amides such as N,N-dimethylformamide and N,N-dimethylacetamide; ethers such as tetrahydrofuran, dioxane, and methyl Cellosolve; esters such as methyl acetate and ethyl acetate; sulfoxides and sulfones, such as dimethyl sulfoxide and sulfolane; aliphatic chlorohydrocarbons such as methylene chloride, chloroform, carbon tetrachloride, and trichloroethane; and aromatics such as benzene, toluene, xylene, monochlorobenzene, and dichlorobenzene.

The present invention will be explained below in more detail by reference to Examples, but the invention should not be construed as being limited to the scope of these Examples. In the Examples, all parts are by weight.

EXAMPLE 1

An aluminum drum (ED pipe) having an outer diameter of 30 mm and a length of 300 mm was prepared as a cylindrical electrically conductive support by subjecting an extruded pipe of aluminum alloy JIS 3003 to precision drawing. The external surface of this aluminum drum was examined with a scanning electron stereomicroscope (ERA-8000, manufactured by ELIONIX K.K.). As a result, groove defects in the form of streaks parallel to the drum axis and randomly oriented depression defects in the form of holes were observed in a large number. Three-dimensional roughness analysis with this apparatus at a field of view of 1,000 diameters revealed that the external surface of this aluminum drum had an index of surface area $[(S_a/S_m)-1]$ of 0.021.

Subsequently, 10 parts of the disazo pigment represented by the formula

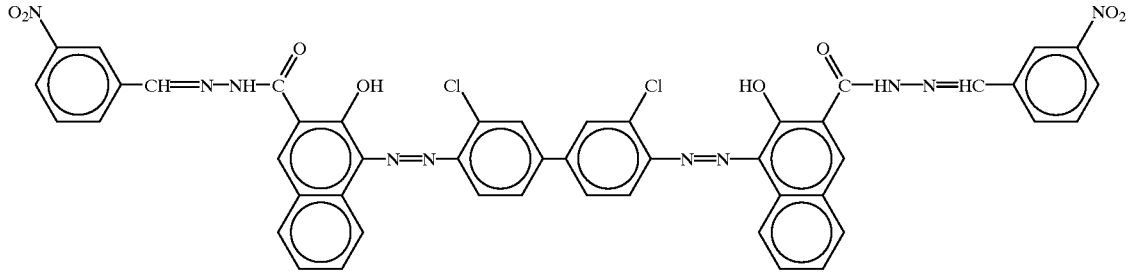

was mixed with a resin solution consisting of 5 parts of a phenolic resin (trade name "Plyophen 5010" manufactured by Dainippon Ink & Chemicals, Inc., Japan) and 40 parts of methyl ethyl ketone (hereinafter abbreviated as MEK). This mixture was treated with a ball mill for 6 hours to disperse the pigment, thereby giving coating composition A for forming a first charge-generating layer. This coating composition was applied to the external surface of the above-described aluminum drum by dip coating in such an amount as to result in a dry thickness of 5 $\mu$m. The coating was then dried with heating at 150° C. for 30 minutes to form a first charge-generating layer.

Five parts of X-form metal-free phthalocyanine was mixed with a resin solution consisting of 5 parts of a butyral resin (trade name "S-Lec BL-1" manufactured by Sekisui Chemical Co., Ltd., Japan) and 190 parts of methylene chloride. This mixture was treated with a vibrating mill to disperse the pigment, thereby giving coating composition B for forming a second charge-generating layer. This coating composition was applied to the first charge-generating layer by dip coating in such an amount as to result in a dry thickness of 0.4 $\mu$m. The coating was then dried with heating in the same manner as the above to form a second charge-generating layer.

Thereafter, 10 parts of the hole-transporting material represented by the formula

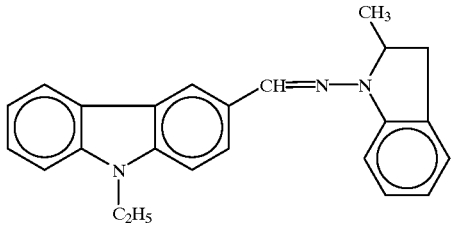

and 10 parts of a polycarbonate resin (trade name "Panlite L-1250W" manufactured by Teijin Chemicals Ltd., Japan) were dissolved in 80 parts of chloroform to prepare a coating composition for forming a charge-transporting layer. This coating composition was applied to the second charge-generating layer by dip coating in such an amount as to result in a dry thickness of 15 $\mu$m. The coating was then dried with heating in the same manner as the above to form a charge-transporting layer. Thus, a drum-form organic photoconductor of the negative electrification type was obtained.

EXAMPLE 2

One part of N,N'-di(3,5-dimethylphenyl)perylene-3,4,9,10-tetracarboxydiimide (trade name "Novoperm Red BL" manufactured by Hoechst AG) and 1 part of a polyamide resin (trade name "CM-8000", manufactured by Toray Industries, Inc., Japan) were mixed with a mixed solvent consisting of 7 parts of methanol and 7 parts of n-butanol. This mixture was treated with a sand mill for 1 hour to disperse the pigment, thereby giving coating composition C for forming a first charge-generating layer.

A first charge-generating layer, a second charge-generating layer, and a charge-transporting layer were successively formed in the same manner as in Example 1, except that coating composition C described above was used in place of coating composition A for forming the first charge-generating layer, and that the thickness of the first charge-generating layer was changed to 3 $\mu$m. Thus, a drum-form organic photoconductor of the negative electrification type was obtained.

COMPARATIVE EXAMPLE 1

A drum-form organic photoconductor of the negative electrification type was obtained in the same manner as in Example 1, except that the first charge-generating layer was omitted and the second charge-generating layer was formed directly on the aluminum drum.

COMPARATIVE EXAMPLE 2

A drum-form organic photoconductor of the negative electrification type was obtained in the same manner as in Example 1, except that a barrier layer was formed in place of the first charge-generating layer by dissolving 1 part of a polyamide resin (trade name "CM-8000" manufactured by Toray Industries, Inc.) in a mixed solvent consisting of 7 parts of methanol and 7 parts of n-butanol, applying this resin solution by dip coating in such an amount as to result in a dry thickness of 1 $\mu$m, and drying the coating.

COMPARATIVE EXAMPLE 3

An aluminum drum having a maximum surface roughness $R_{max}$ of 0.3 $\mu$m was prepared as a cylindrical electrically conductive support by subjecting an extruded pipe of aluminum alloy JIS 3003 to surface finishing by turning by means of a precision lathe having a diamond tool. (This kind of drum is hereinafter referred to as a turning-finished pipe.) The external surface of this drum was examined with the scanning electron stereomicroscope. As a result, neither groove defects in the form of streaks parallel to the drum axis nor depression defects in the form of holes were observed at all. Three-dimensional roughness analysis with this apparatus at a field of view of 1,000 diameters revealed that the external surface of this drum had an index of surface area $[(S_a/S_m)-1]$ of 0.001.

A drum-form organic photoconductor of the negative electrification type was obtained in the same manner as in Comparative Example 1, except that the turning-finished pipe described above was used in place of the ED pipe.

EXAMPLE 3

An aluminum drum (EI pipe) having the same shape as in Example 1 was prepared as a cylindrical electrically conductive support by subjecting an extruded pipe of aluminum alloy JIS 3003 to ironing. The external surface of this drum was examined with the scanning electron stereomicroscope. As a result, groove defects in the form of streaks parallel to the drum axis and randomly oriented depression defects in the form of holes were observed in a large number as in Example 1. Three-dimensional roughness analysis with this apparatus at a field of view of 1,000 diameters revealed that the external surface of this drum had an index of surface area $[(S_a/S_m)-1]$ of 0.015.

Subsequently, 1 part of dibromoanthanthrone (manufactured by ICI Ltd.) and 1 part of a phenoxy resin (trade name "PKHH" manufactured by Union Carbide Corp.) were mixed with a mixed solvent consisting of 7 parts of 1-acetoxy-2-methoxyethane and 7 parts of methyl ethyl ketone. This mixture was treated with a sand mill for 1 hour to disperse the pigment, thereby giving coating composition D for forming a first charge-generating layer.

A first charge-generating layer, a second charge-generating layer, and a charge-transporting layer were successively formed in the same manner as in Example 1, except that the EI pipe described above was used as a cylindrical electrically conductive support, that coating composition D described above was used in place of coating composition A for forming the first charge-generating layer, and that the thickness of the first charge-generating layer was changed to 6 $\mu$m. Thus, a drum-form organic photoconductor of the negative electrification type was obtained.

EXAMPLE 4

A drum-form organic photoconductor of the negative electrification type was obtained in the same manner as in Example 3, except that trans-bis(benzimidazolyl)perinone (trade name "Hostapermorange GR" manufactured by Hoechst AG) was used in place of dibromoanthanthrone as a charge-generating material for the first charge-generating layer.

COMPARATIVE EXAMPLE 4

A drum-form organic photoconductor of the negative electrification type was obtained in the same manner as in Example 3, except that the first charge-generating layer was omitted and the second charge-generating layer was formed directly on the aluminum drum.

EXAMPLES 5 TO 8

Drum-form organic photoconductors of the negative electrification type (Examples 5 to 8) were obtained in the same manner as in Examples 1 to 4, respectively, except that $\alpha$-form titanyl phthalocyanine was used as a charge-generating agent in place of X-form metal-free phthalocyanine to form a second charge-generating layer.

COMPARATIVE EXAMPLES 5 TO 8

Drum-form organic photoconductors of the negative electrification type (Comparative Examples 5 to 8) were obtained in the same manner as in Comparative Examples 1 to 4, respectively, except that $\alpha$-form titanyl phthalocyanine was used as a charge-generating agent in place of X-form metal-free phthalocyanine to form a charge-generating layer.

EXAMPLE 9

An aluminum drum was prepared as a cylindrical electrically conductive support from aluminum alloy JIS 1100 through the same precision drawing as in Example 1. During this precision drawing, the load resistance became slightly high and this resulted in slightly poor surface properties. The external surface of this drum was examined with the scanning electron stereomicroscope. As a result, not only groove defects in the form of streaks parallel to the drum axis and depression defects in the form of holes were observed as in the aluminum drum used in Example 1, but also many defects in the form of cracks were observed. Three-dimensional roughness analysis with this apparatus at a field of view of 1,000 diameters revealed that the external surface of this aluminum drum had an index of surface area $[(S_a/S_m)-1]$ of 0.075.

Coating composition A used in Example 1 for forming a first charge-generating layer was applied to the external surface of the above-described aluminum drum by dip coating in such an amount as to result in a dry thickness of 8 $\mu$m. The coating was then dried with heating at 150° C. for 30 minutes to form a first charge-generating layer. Subsequently, a second charge-generating layer and a charge-transporting layer were formed on the first charge-generating layer under the same conditions as in Example 5.

Thus, a drum-form organic photoconductor of the negative electrification type was obtained.

COMPARATIVE EXAMPLE 9

An aluminum drum was prepared as a cylindrical electrically conductive support by subjecting an extruded pipe of aluminum alloy JIS 3003 to ordinary drawing. The external surface of this drum was examined with the scanning electron stereomicroscope. As a result, groove defects in the form of streaks parallel to the drum axis and depression defects in the form of holes were observed at an extremely high frequency as in the aluminum drum used in Example 1. Three-dimensional roughness analysis with this apparatus at a field of view of 1,000 diameters revealed that the external surface of this aluminum drum had an index of surface area $[(S_a/S_m)-1]$ of 0.123.

A first charge-generating layer, a second charge-generating layer, and a charge-transporting layer were successively formed in the same manner as in Example 9, except that this aluminum drum was used as a cylindrical electrically conductive support. Thus, a drum-form organic photoconductor of the negative electrification type was obtained.

(Ascertainment of Electrical Junction)

The state of electrical junction between the first charge-generating layer formed in Example 1 and an aluminum support was examined as follows. Coating composition A used in Example 1 for forming the first charge-generating layer was applied to a 1 mm-thick aluminum plate in such an amount as to result in a dry thickness of 5 $\mu$m, and the coating was dried. Gold was then vapor-deposited on the resulting first charge-generating layer to fabricate a sandwich cell in which the first charge-generating layer was sandwiched between a gold electrode and an aluminum electrode. A direct voltage was applied to the two electrodes to examine the relationship between the resulting current and the applied voltage. The results obtained are shown in FIG. 2.

As shown in FIG. 2, the cell exhibited such rectifying properties that almost no current flowed during application of a positive voltage to the aluminum side, whereas a strong current flowed during application of a negative voltage to the aluminum side. The facts that the disazo pigment used in Example 1 is an n-type semiconductor and that the factor which governs current is the transport of negative charges are apparent from, e.g., *Photographic Science and Engineering*, Vol. 28, pp. 195–199 (1984). The above results clearly show that there was no barrier to electron injection between the aluminum and the disazo pigment and a non-rectifying (ohmic) junction had been established therebetween, while a Schottky junction had been established at the interface between the gold and the disazo pigment to inhibit electron injection from the gold.

In the same manner as the above, the first charge-generating layer used in each of Examples 2 to 4 was also examined. As a result, it was ascertained that the same electrical junction as in Example 1 had been established for these first charge-generating layers.

(Image Property)

Image properties were evaluated as follows. Each of the drum-form organic photoconductors obtained in the Examples and the Comparative Examples was mounted in a commercial laser printer (trade name "Laser Shot LBP-B406" manufactured by Canon Corp., which employs a drum-form organic photoconductor). Printing test was performed in a 23° C. 50% RH atmosphere to evaluate image defects. The results obtained are summarized in Tables 1 and 2. In this test, five samples were evaluated with respect to each of the drum-form organic photoconductors obtained in the Examples and the Comparative Examples, and the results for the five samples were averaged. The prints were also evaluated for background fog in the four grades specified below,i.e., A, B, C, and D. The number of defects is shown in terms of the number of defects per drum, which was calculated from the number of defects present in one B4-size print.

<Criteria for Background Fog Evaluation>

A white copy was printed, and a square therein having dimensions of 2 mm by 2 mm was examined for toner deposition with a 50× magnifier. The proportion of the area where toner had been deposited in the square to the whole area of the square was determined, and is shown based on the following criteria.

A: The maximum value of that areal proportion is below 0.1% irrespective of the printing region.

B: The maximum value of that areal proportion is 0.1% or higher and below 0.5% irrespective of the printing region.

C: The maximum value of that areal proportion is 0.5% or higher and below 1.0% irrespective of the printing region.

D: The maximum value of that areal proportion is 1.0% or higher irrespective of the printing region.

TABLE 1

| | Example | | | | | | | | |
|---|---|---|---|---|---|---|---|---|---|
| Evaluation | 1 | 2 | 3 | 4 | 5 | 6 | 7 | 8 | 9 |
| Background fog | A | A | A | A | A | A | A | A | A |
| Number of image defects | 0 | 0 | 0 | 0 | 0 | 0 | 0 | 0 | 0 |

TABLE 2

| | Comparative Example | | | | | | | | |
|---|---|---|---|---|---|---|---|---|---|
| Evaluation | 1 | 2 | 3 | 4 | 5 | 6 | 7 | 8 | 9 |
| Background fog | C | B | B | C | C | B | B | C | A |
| Number of image defects | 8 | 4 | 1 | 7 | 7 | 3 | 2 | 6 | 2 |

The results summarized in Tables 1 and 2 clearly show the following. Each of the organic photoconductors obtained in the Examples gave satisfactory clear images free from background fog and image defects, despite the use of a cylindrical electrically conductive support having a large value of the index of surface area. In contrast, the organic photoconductors obtained in Comparative Examples 1, 4, 5, and 8, which employed the same cylindrical electrically conductive support as in the Examples and had no barrier layer, were far inferior in background fog. Further, the organic photoconductors obtained in Comparative Examples 2 and 6, which had a barrier layer, and the organic photoconductors obtained in Comparative Examples 3 and 7, which employed a drum support surface-finished by precision turning to have a small value of the index of surface area, were considerably inferior in performance to the organic photoconductors obtained in the Examples, although improved in image quality in some degree. Furthermore, the organic photoconductor obtained in Comparative Example 9, which employed a support having such an extremely poor surface state that the index of surface area thereof exceeded 0.10, was apt to cause image defects, although it gave excellent results in the evaluation of background fog.

(Electrical Property)

Electrical properties of the organic photoconductors obtained in the Examples and the Comparative Examples were evaluated as follows. The same photosensitive layer as in each of the organic photoconductors obtained in Examples 1 to 9 and Comparative Examples 1 to 9 was formed on an aluminum plate to fabricate a plate-form organic photoconductor. Each of these organic photoconductors was examined for electrophotographic properties with electrostatic paper analyzer Model SP-428 (manufactured by Kawaguchi Electric Works Co., Ltd., Japan). In this examination, each organic photoconductor was first charged in the dark with corona discharge at an applied voltage of −6 kV. The surface potential as measured immediately thereafter was used as initial potential $V_0$ for evaluating the ability to be charged. Subsequently, each organic photoconductor was allowed to stand in the dark for 10 seconds, and the potential $V_{10}$ was then measured. The ability to retain potential was evaluated in terms of $V_0/V_{10}$. The photosensitive layer was then irradiated for 15 seconds with light from a tungsten lamp regulated so as to illuminate the photosensitive-layer surface at an illuminance of 5 lx, during which irradiation a curve of surface potential decay was recorded. The surface potential as measured after the 15-second irradiation was taken as residual potential $V_R$. Further, the exposure required for the surface potential to decrease to ½ of $V_{10}$ was determined; this exposure value was used as half-decay exposure $E_{1/2}$ for sensitivity evaluation. In addition, a step in which the photosensitive layer was charged and then irradiated for 0.1 second with white light at 3,000 lx for charge erasion was repeated 100 times at an interval of 1 second, following which the same measurements as the above were made. Thus, each organic photoconductor was evaluated for property change through the repeated cycling. The results obtained are shown in Tables 3 and 4.

The results for the organic photoconductors obtained in Comparative Examples 3, 4, 7, 8, and 9 are not shown in those tables, because the organic photoconductors of Comparative Examples 3 and 4 had the same layer constitution as the organic photoconductor of Comparative Example 1, the organic photoconductors of Comparative Examples 7 and 8 had the same layer constitution as the organic photoconductor of Comparative Example 5, and the organic photoconductor of Comparative Example 9 had the same layer constitution as the organic photoconductor of Example 9.

TABLE 3

| Example | Time of Measurement | $V_0$ (V) | $V_{10}/V_0$ (%) | $V_R$ (V) | $E_{1/2}$ (lx · sec) |
|---|---|---|---|---|---|
| 1 | Initial | −815 | 81 | −6 | 1.3 |
| | After repeated cycling | −813 | 79 | −10 | 1.3 |
| 2 | Initial | −813 | 82 | −5 | 1.4 |
| | After repeated cycling | −810 | 80 | −6 | 1.4 |
| 3 | Initial | −822 | 83 | −7 | 1.4 |
| | After repeated cycling | −820 | 81 | −7 | 1.5 |
| 4 | Initial | −815 | 82 | −5 | 1.3 |
| | After repeated cycling | −813 | 80 | −6 | 1.4 |
| 5 | Initial | −821 | 80 | −3 | 0.9 |
| | After repeated cycling | −815 | 78 | −2 | 0.9 |
| 6 | Initial | −815 | 81 | −3 | 1.1 |
| | After repeated cycling | −810 | 79 | −4 | 1.0 |
| 7 | Initial | −828 | 83 | −6 | 1.1 |
| | After repeated cycling | −825 | 82 | −7 | 1.1 |
| 8 | Initial | −817 | 81 | −3 | 1.0 |
| | After repeated cycling | −815 | 81 | −3 | 1.0 |
| 9 | Initial | −832 | 83 | −5 | 0.9 |
| | After repeated cycling | −824 | 81 | −7 | 1.0 |

TABLE 4

| Comparative Example | Time of Measurement | $V_0$ (V) | $V_{10}/V_0$ (%) | $V_R$ (V) | $E_{1/2}$ (lx · sec) |
|---|---|---|---|---|---|
| 1 | Initial | −798 | 76 | −8 | 1.6 |
| | After repeated cycling | −810 | 74 | −10 | 1.6 |
| 2 | Initial | −816 | 80 | −10 | 1.6 |
| | After repeated cycling | −824 | 75 | −13 | 1.8 |
| 5 | Initial | −808 | 79 | −6 | 1.2 |
| | After repeated cycling | −819 | 78 | −13 | 1.3 |
| 6 | Initial | −826 | 82 | −10 | 1.4 |
| | After repeated cycling | −832 | 80 | −15 | 1.4 |

The results summarized in Tables 3 and 4 clearly show the following. The organic photoconductors obtained in the Examples showed higher performances with respect to sensitivity, potential-retaining ability, and residual potential and showed smaller property changes through repeated cycling than the organic photoconductors obtained in Comparative Examples 1 and 5, which had the same constitution as the Examples except that they had no first charge-generating layer. On the other hand, the organic photoconductors obtained in Comparative Examples 2 and 6, which had a barrier layer in place of a first charge-generating layer, were inferior in sensitivity, residual potential, and properties after repeated cycling to the organic photoconductors obtained in the Examples, although improved in charge acceptance as compared with the organic photoconductors obtained in Comparative Examples 1 and 5.

The present invention can provide an organic photoconductor which employs an inexpensive cylindrical electrically conductive support having a large value of the index of surface area but is free from the image defects caused by surface defects characteristic of such a support, and which is capable of attaining such high image quality and excellent electrostatic properties.

While the invention has been described in detail and with reference to specific embodiments thereof, it will be apparent to one skilled in the art that various changes and modifications can be made therein without departing from the spirit and scope thereof.

What is claimed is:

1. An organic photoconductor comprising a cylindrical electrically conductive support and, formed thereon in this order, a charge-generating layer and a charge-transporting layer, the external surface of said cylindrical electrically conductive support having an index of surface area as defined by the following equation (I) of from 0.01 to 0.10, and said charge-generating layer having a multilayer structure comprising a charge-generating layer having n-type semiconductor characteristics and a charge-generating layer having p-type semiconductor characteristics:

$$(S_a/S_m)-1 \quad (I)$$

wherein $S_a$ is the actual surface area of the external surface of said cylindrical electrically conductive support and $S_m$ is the theoretical surface area thereof calculated on the assumption that said support is an ideal cylinder.

2. The organic photoconductor as claimed in claim 1, wherein said cylindrical electrically conductive support has, on the surface thereof, groove defects in the form of streaks parallel to the cylinder axis and depression defects in the form of holes.

3. The organic photoconductor as claimed in claim 2, wherein said cylindrical electrically conductive support is either a cylindrical electrically conductive support which has undergone surface finishing by means of precision drawing or a cylindrical electrically conductive support which has undergone surface finishing by means of ironing.

4. The organic photoconductor as claimed in claim 1, wherein said charge-generating layer comprises a first charge-generating layer in contact with said cylindrical electrically conductive support and a second charge-generating layer formed on said first charge-generating layer, the thickness of said first charge-generating layer being in the range of from 1.0 to 10.0 $\mu$m.

5. The organic photoconductor as claimed in claim 4, wherein said cylindrical electrically conductive support is in non-rectifying junction with a charge-generating material contained in said first charge-generating layer.

6. The organic photoconductor as claimed in claim 4, wherein said first charge-generating layer is a charge-generating layer having n-type semiconductor characteristics, and said second charge-generating layer is a charge-generating layer having p-type semiconductor characteristics.

7. The organic photoconductor as claimed in claim 1, wherein said charge-generating layer having n-type semiconductor characteristics contains a pigment selected from the group consisting of a disazo pigment, a perylene pigment, an anthanthrone pigment, and a perinone pigment.

8. The organic photoconductor as claimed in claim 1, wherein said charge-generating layer having p-type semiconductor characteristics contains a pigment selected from the group consisting of a titanyl phthalocyanine pigment and a metal-free phthalocyanine pigment.

9. The organic photoconductor as claimed in claim 1, wherein said charge-generating layer having n-type semiconductor characteristics contains a disazo pigment and said charge-generating layer having p-type semiconductor characteristics contains titanyl phthalocyanine.

10. The organic photoconductor as claimed in claim 1, wherein said charge-generating layer having n-type semiconductor characteristics contains a perylene pigment and said charge-generating layer having p-type semiconductor characteristics contains titanyl phthalocyanine.

11. The organic photoconductor as claimed in claim 1, wherein said charge-generating layer having n-type semiconductor characteristics contains an anthanthrone pigment and said charge-generating layer having p-type semiconductor characteristics contains titanyl phthalocyanine.

12. The organic photoconductor as claimed in claim 1, wherein said charge-generating layer having n-type semiconductor characteristics contains a perinone pigment and said charge-generating layer having p-type semiconductor characteristics contains titanyl phthalocyanine.

13. The organic photoconductor as claimed in claim 1, wherein said charge-generating layer having n-type semiconductor characteristics contains a disazo pigment and said charge-generating layer having p-type semiconductor characteristics contains metal-free phthalocyanine.

14. The organic photoconductor as claimed in claim 1, wherein said charge-generating layer having n-type semiconductor characteristics contains a perylene pigment and said charge-generating layer having p-type semiconductor characteristics contains metal-free phthalocyanine.

15. The organic photoconductor as claimed in claim 1, wherein said charge-generating layer having n-type semiconductor characteristics contains an anthanthrone pigment and said charge-generating layer having p-type semiconductor characteristics contains metal-free phthalocyanine.

16. The organic photoconductor as claimed in claim 1, wherein said charge-generating layer having n-type semiconductor characteristics contains a perinone pigment and said charge-generating layer having p-type semiconductor characteristics contains metal-free phthalocyanine.

17. The organic photoconductor as claimed in claim 1, wherein said charge-transporting layer contains a hydrazone compound.

18. The organic photoconductor as claimed in claim 1, used in an electrophotographic apparatus in which a latent image is formed by exposure with a coherent light.

19. The organic photoconductor as claimed in claim 18, wherein said electrophotographic apparatus is a laser printer.

* * * * *